US010325539B2

(12) United States Patent
Shi et al.

(10) Patent No.: US 10,325,539 B2
(45) Date of Patent: Jun. 18, 2019

(54) DISPLAY METHOD, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lingyun Shi, Beijing (CN); Xue Dong, Beijing (CN); Hao Zhang, Beijing (CN); Renwei Guo, Beijing (CN); Liguang Deng, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 290 days.

(21) Appl. No.: 14/437,006

(22) PCT Filed: Aug. 27, 2014

(86) PCT No.: PCT/CN2014/085288
§ 371 (c)(1),
(2) Date: Apr. 20, 2015

(87) PCT Pub. No.: WO2015/143832
PCT Pub. Date: Oct. 1, 2015

(65) Prior Publication Data

US 2016/0300519 A1 Oct. 13, 2016

(30) Foreign Application Priority Data

Mar. 25, 2014 (CN) ..... 2014 1 0114233

(51) Int. Cl.
*G09G 3/32* (2016.01)
*G09G 3/20* (2006.01)

(52) U.S. Cl.
CPC ..... *G09G 3/2003* (2013.01); *G09G 3/32* (2013.01); *G09G 2300/0443* (2013.01);
(Continued)

(58) Field of Classification Search
CPC ..... G09G 3/2003; G09G 3/2074; G09G 3/3607; G09G 2340/0457;
(Continued)

(56) References Cited

U.S. PATENT DOCUMENTS 6,686,985 B1 2/2004 Tanaka et al.
2004/0150651 A1 8/2004 Phan
(Continued)

FOREIGN PATENT DOCUMENTS

CN 1499477 A 5/2004
CN 1614659 A 5/2005
(Continued)

OTHER PUBLICATIONS

Extended European Search Report issued in corresponding European application No. 14 85 3157.7 dated May 24, 2016.
(Continued)

*Primary Examiner* — Nitin Patel
*Assistant Examiner* — Amen Bogale
(74) *Attorney, Agent, or Firm* — Nath, Goldberg & Meyer; Joshua B. Goldberg; Daniel Bissing

(57) ABSTRACT

The present invention provides a display method, a display panel and a display device. The display panel comprises a plurality of rows of sub-pixels, the adjacent sub-pixels in the column direction having different colors and being staggered from each other. The display method comprises: S1, generating an original image composed of a matrix of virtual
(Continued)

pixels; S2, enabling the virtual pixels to correspond to sampling locations, wherein among the sampling locations in each row, one sampling location is further included between two sampling locations corresponding to any two adjacent virtual pixels; in two adjacent rows of sampling locations, the sampling locations corresponding to the virtual pixels are not in the same columns, wherein each sampling location corresponds to a location between two sub-pixels in one row and a middle location of a sub-pixel in the other row; and S3, calculating a display component of each sub-pixel.

14 Claims, 2 Drawing Sheets

(52) U.S. Cl.
CPC ..... *G09G 2300/0452* (2013.01); *G09G 2300/0465* (2013.01); *G09G 2340/0407* (2013.01); *G09G 2340/0414* (2013.01); *G09G 2340/0457* (2013.01); *G09G 2360/16* (2013.01)

(58) Field of Classification Search
CPC ... G09G 2340/0414; G09G 2340/0407; G09G 2340/06; G09G 2300/0452; G09G 2300/0443; G09G 2300/0465; G09G 2340/10; G09G 2340/04; G09G 2340/0428; G09G 2340/0464; G09G 2340/0471; G09G 2340/0478; G09G 2340/0485; G09G 2340/0421; G09G 5/02; G09G 2320/0666; G06T 3/4069; G06T 3/4007; G06T 3/40; H01L 27/3218
See application file for complete search history.

(56) References Cited

U.S. PATENT DOCUMENTS

| | | | | |
|---|---|---|---|---|
| 2007/0109468 | A1* | 5/2007 | Oku | G02F 1/133514 349/110 |
| 2008/0030527 | A1* | 2/2008 | Namie | G06T 3/4023 345/698 |
| 2009/0128467 | A1* | 5/2009 | Chen | G09G 3/3607 345/87 |
| 2011/0140999 | A1* | 6/2011 | Beland | G06F 3/1446 345/82 |
| 2011/0206297 | A1 | 8/2011 | Tsuda et al. | |
| 2012/0293531 | A1* | 11/2012 | Wang | G09G 3/2003 345/589 |
| 2015/0097837 | A1* | 4/2015 | Jepsen | G06F 3/1446 345/428 |

FOREIGN PATENT DOCUMENTS

| | | | |
|---|---|---|---|
| CN | 201004298 | Y | 1/2008 |
| CN | 101123079 | A | 2/2008 |
| CN | 201897933 | U | 7/2011 |
| CN | 102622981 | A | 8/2012 |
| CN | 103886808 | A | 6/2014 |
| CN | 103886809 | A | 6/2014 |
| CN | 103886825 | A | 6/2014 |
| CN | 103903524 | A | 7/2014 |
| CN | 103903549 | A | 7/2014 |
| CN | 103915044 | A | 7/2014 |
| CN | 103927946 | A | 7/2014 |
| EP | 2333760 | A2 | 6/2011 |
| JP | 2007324667 | A | 12/2007 |

OTHER PUBLICATIONS

Notification of the First Office Action dated Sep. 14, 2015 corresponding to Chinese application No. 201410114233.4.
Written Opinion of the International Searching Authority dated Dec. 30, 2014 corresponding to International application No. PCT/CN2014/085288.

* cited by examiner

Display image according to the prior art method

Display image according to the method of the embodiment of the present invention

DISPLAY METHOD, DISPLAY PANEL AND DISPLAY DEVICE

This is a National Phase Application filed under 35 U.S.C. 371 as a national stage of PCT/CN2014/085288, filed Aug. 27, 2014, an application claiming the benefit of Chinese Application No. 201410114233.4, filed Mar. 25, 2014, the content of each of which is hereby incorporated by reference in its entirety.

FIELD OF THE INVENTION

The present invention relates to the field of display technology, and particularly to a display method, a display panel and a display device.

BACKGROUND OF THE INVENTION

As illustrated in FIG. 1, a traditional display panel includes a plurality of 'pixels 1' arranged in a matrix, in which each pixel 1 is composed of three adjacent red, green and blue sub-pixels 9 which are arranged in a row. Each sub-pixel 9 can independently emit light of certain luminance (of course the light has specific color), and by light mixing effect the three sub-pixels 9 together constitute an independent display 'point' on a screen.

With the development of technology, the resolution of a display panel becomes increasingly higher, which requires reducing the dimension of the pixel (or the sub-pixel) in the display panel. However, due to limitation of processes, the dimension of the sub-pixel cannot be infinitely reduced, which becomes a bottleneck restricting further improvement in resolution. In order to solve the problem mentioned above, a virtual algorithm technology may be employed to improve the resolution 'sensed' by the user by 'sharing' the sub-pixels; that is to say, one sub-pixel can be used for displaying contents in a plurality of pixels, thereby enabling the visual resolution to be higher than the actual physical resolution.

However, the effect of the existing virtual algorithm technologies is not good enough, some will cause defects such as image distortion, jagged lines, grid spots and the like and some will require calculations such as picture partitioning, picture layering and area ratio, resulting in complex process and large calculation amount.

SUMMARY OF THE INVENTION

In view of the problem that the effect of the existing high resolution display technology is not good enough, the object of the present invention is to provide a display method, a display panel and a display device, which can realize high resolution display and provide good display effect.

A technical solution employed to solve the technical problem of the present invention is a display method applied to a display panel, wherein the display panel includes a plurality of rows of sub-pixels, the sub-pixels in each row are formed by cyclically arranging sub-pixels of three colors, the cyclical orders of the sub-pixels in the respective rows are the same, and the adjacent sub-pixels in the column direction have different colors and are staggered from each other by ½ of the sub-pixel in the row direction. The display method comprises the following steps:

S1, generating an original image composed of a matrix of virtual pixels;

S2, enabling the virtual pixels to correspond to sampling locations, wherein among the sampling locations in each row, one sampling location is further included between two sampling locations corresponding to any two adjacent virtual pixels; in two adjacent rows of sampling locations, the sampling locations corresponding to the virtual pixels are not in the same columns, wherein each sampling location is located between every two adjacent rows of sub-pixels, and corresponds to a location between two sub-pixels in one row and a middle location of a sub-pixel in the other row; and S3, calculating a display component of each sub-pixel in accordance with original components of corresponding colors of the virtual pixels corresponding to the sub-pixel.

The terms 'row' and the 'column' used herein refer to two directions perpendicular to each other in the matrix of virtual pixels (or sub-pixels), which are irrelevant to the shape of the sub-pixels, placement of the display panel, layout of leads and the like.

Optionally, the display panel is a liquid crystal display panel or an organic light-emitting diode (OLED) display panel.

Optionally, the sub-pixels of three colors are a red sub-pixel, a blue sub-pixel and a green sub-pixel.

Optionally, in the first row and last row of sub-pixels of the display panel, in one row, except two sub-pixels at the ends of the row, each sub-pixel corresponds to two virtual pixels, the dimension of a sub-pixel in this row in the column direction is ⅔ of that of a standard sub-pixel in the column direction; in the other row, except two sub-pixels at the ends of the row, each sub-pixel corresponds to one virtual pixel, the dimension of a sub-pixel in this row in the column direction is ⅓ of that of a standard sub-pixel in the column direction. The standard sub-pixel refers to a sub-pixel which is not located at the edge of the display panel.

Optionally, in each row including the standard sub-pixels, one of the two sub-pixels at the ends of the row corresponds to two virtual pixels, the dimension of this sub-pixel in the row direction is ⅔ of that of a standard sub-pixel in the row direction; the other sub-pixel corresponds one virtual pixel, the dimension of this sub-pixel in the row direction is ⅓ of that of a standard sub-pixel in the row direction.

Optionally, the step S3 includes: obtaining a display component of each sub-pixel by multiplying the original components of the corresponding colors of the virtual pixels corresponding to the sub-pixel by respective proportional coefficients and then summarizing the respective products.

Further optionally, the sum of the proportional coefficients for the original components of the corresponding colors of the respective virtual pixels corresponding to each sub-pixel is 1.

Further optionally, the proportional coefficient for the original component of corresponding color of the virtual pixel corresponding to the middle of a standard sub-pixel ranges from 0.5 to 0.9.

Further optionally, except the virtual pixel corresponding to the middle of the standard sub-pixel, the proportional coefficients for the original component of corresponding color of the other two virtual pixels corresponding to the sub-pixel are equivalent to each other.

Optionally, both the original component and the display component are luminance, and the method further includes a step S4 after the step S3: calculating the gray scale of each sub-pixel in accordance with the display component of the sub-pixel.

The present invention further provides a display panel comprising a plurality of rows of sub-pixels, in which the sub-pixels in each row are formed by cyclically arranging sub-pixels of three colors, and the cyclical orders of the sub-pixels in the respective rows are the same, the adjacent sub-pixels in the column direction have different colors and are staggered from each other by ½ of the sub-pixel in the row direction.

The present invention further provides a display device comprising the display panel, the display device comprises a plurality of rows of sub-pixels, in which the sub-pixels in each row are formed by cyclically arranging sub-pixels of three colors, and the cyclical orders of the sub-pixels in the respective rows are the same, the adjacent sub-pixels in the column direction have different colors and are staggered from each other by ½ of the sub-pixel in the row direction.

In the display method of the present invention, the content displayed by each sub-pixel (i.e. standard sub-pixel) is substantially determined by 3 virtual pixels adjacent to this sub-pixel. That is, one sub-pixel is 'shared' by 3 virtual pixels; or rather, each sub-pixel is used for representing the contents of the 3 virtual pixels at the same time, thereby enabling the visual resolution to be three times of the actual physical resolution in combination with a specific display panel and achieving a better display effect. At the same time, the content displayed by each sub-pixel is directly obtained by calculation based on a plurality of specific virtual pixels without complex calculations such as 'partitioning, layering and area ratio'. Therefore, the display method requires simple process and small calculation amount.

The present invention is especially suitable for high resolution display.

REFERENCE NUMERALS

1: Pixel
2: Virtual pixel
8: Sampling location
9: Sub-pixel

DETAILED DESCRIPTION OF THE EMBODIMENTS

The present invention will be further described below in conjunction with the accompanying drawings and embodiments, in order to make a person skilled in the art better understand the technical solution of the present invention

Embodiment 1

Figure 1:
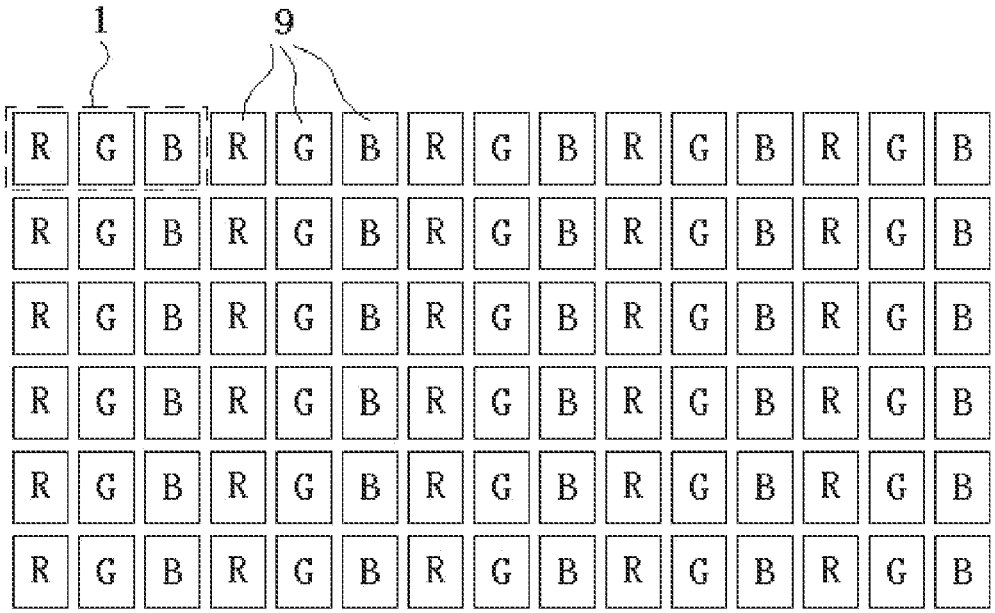
FIG. 1 is a structural diagram of an existing display panel.
Figure 2:
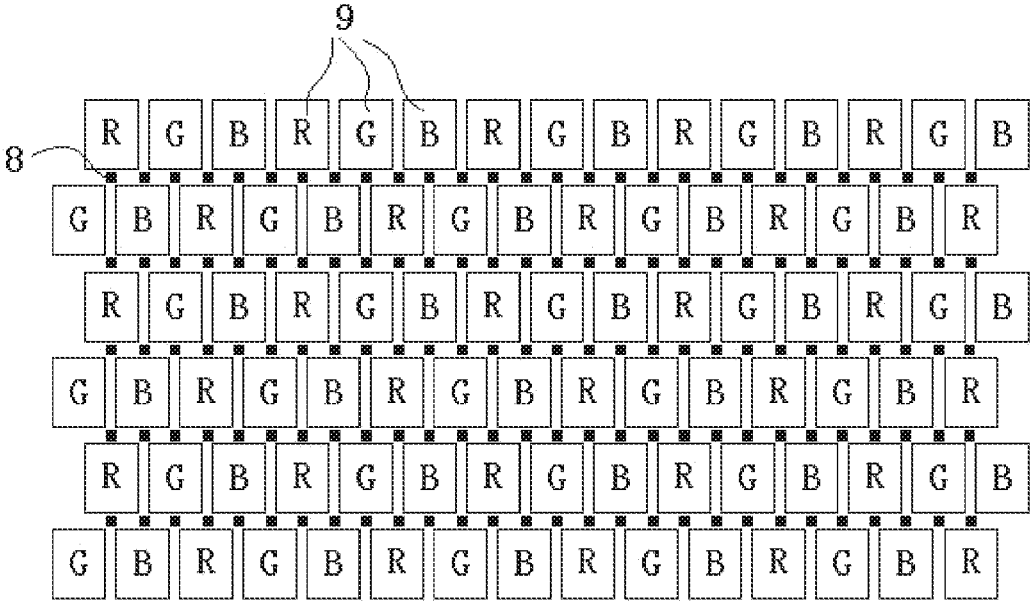
FIG. 2 is a structural diagram of a display panel using a display method of embodiment 1 of the present invention.
Figure 3:
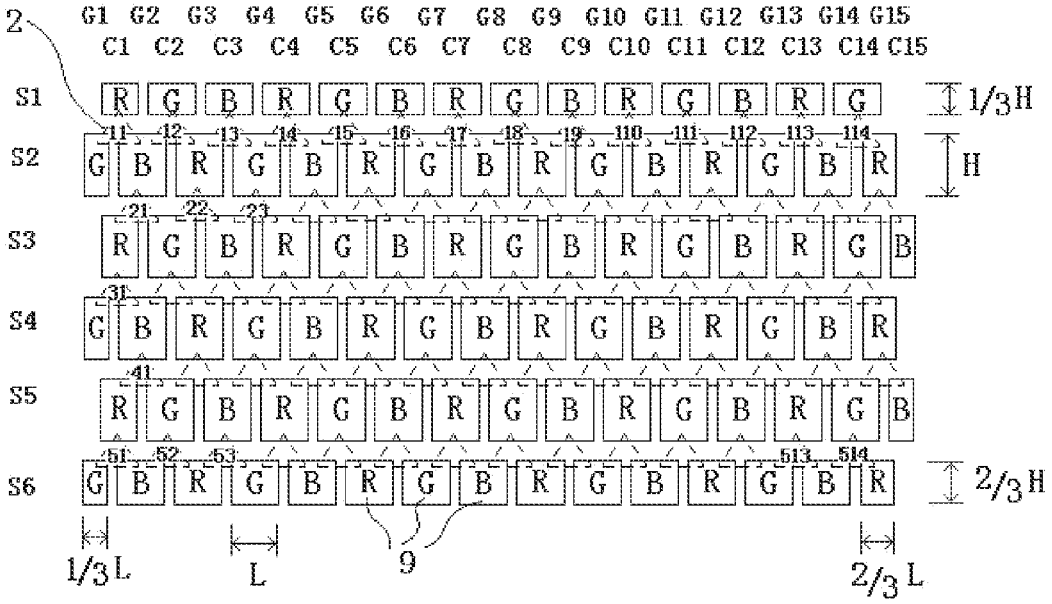
FIG. 3 is a schematic diagram illustrating locations corresponding to virtual pixels in the display method of embodiment 1 of the present invention.
Figure 4:
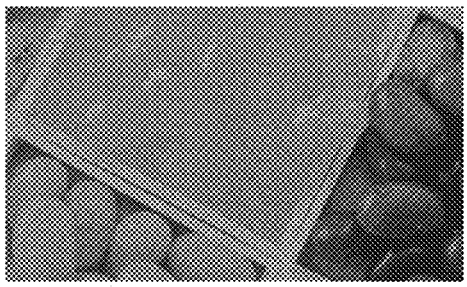
FIG. 4 is a comparison diagram illustrating display effects of the existing method and the method of embodiment 1 of the present invention.
Figure 4:
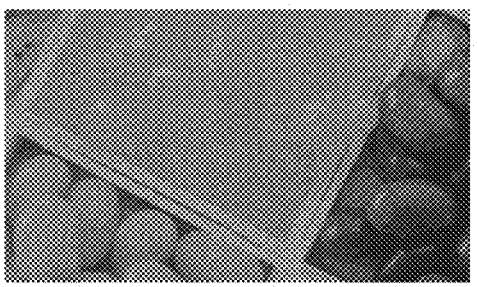

As illustrated in FIG. 2 to FIG. 4, the embodiment provides a display method, which is suitable for a display panel of the embodiment.

The display panel of the embodiment includes a plurality of rows of sub-pixels 9, in which the sub-pixels 9 in each row are formed by cyclically arranging sub-pixels 9 of three colors in turn, and cyclical orders of the sub-pixels 9 in the respective rows are the same. Optionally, the sub-pixels 9 of three colors are red sub-pixels 9, blue sub-pixels 9 and green sub-pixels 9, respectively, and the embodiment will be described by taking this mode as an example, i.e. the display panel of the embodiment is in an RGB mode. Of course, the display methods of the present invention are also applicable to the display panels having other arrangement modes, such as arrangement including other colors or arrangement in which the number of the sub-pixels in each pixel is 2, 4 or other number.

That is, as illustrated in FIG. 2, the sub-pixels 9 of three different colors in each row form a cyclical unit (for example, a cyclical unit of 'red sub-pixel 9 to green sub-pixel 9 to blue sub-pixel 9'), and a plurality of cyclical units constitute a row of sub-pixels 9; in different rows, starting sub-pixels 9 have different colors, but the cyclical arrangement orders of the sub-pixels 9 are the same. For example, in FIG. 2, the first sub-pixel in the first row is a red sub-pixel 9, and the sub-pixels in the first row are cyclically arranged according to an order of 'red sub-pixel 9 to green sub-pixel 9 to blue sub-pixel 9 to red sub-pixel 9'; the first sub-pixel in the second row is a green sub-pixel 9, and the sub-pixels in the second row are cyclically arranged according to an order of 'green sub-pixel 9 to blue sub-pixel 9 to red sub-pixel 9 to green sub-pixel 9'. It can be seen that, the cyclical orders of the sub-pixels 9 in the two rows are actually the same.

Meanwhile, the adjacent sub-pixels 9 in the column direction are staggered from each other by ½ of the sub-pixel in the row direction, and the sub-pixels 9 of the same color are not located in the same column.

That is, the adjacent rows in the display panel of the embodiment are not 'aligned' in the column direction, but are 'staggered' from each other by ½ of the sub-pixel 9. Therefore, in the column direction, except the few sub-pixels 9 at the edges, each sub-pixel 9 is adjacent to two sub-pixels 9 in the adjacent row, and moreover, the sub-pixel 9 has a color different from those of the two sub-pixels 9, since the sub-pixels 9 of the same color are not located in the same column. In this way, any three adjacent sub-pixels 9 of different colors will constitute a ⁞⁞ arrangement which enables the sub-pixels 9 of three colors to be distributed more uniformly and the display quality to be better.

Optionally, the display panel of the embodiment is an organic light-emitting diode (OLED) panel, that is to say, each sub-pixel 9 thereof includes a light-emitting unit (organic light-emitting diode), and the light-emitting unit of each sub-pixel 9 directly emits light of required color and luminance. Or, the display panel can also be a liquid crystal display panel, that is to say, each sub-pixel 9 thereof includes a filter unit, and the light becomes the light of required color and luminance after transmitting the filter unit of each sub-pixel 9.

In summary, the display panel may be of various types, so long as distribution of the sub-pixels 9 thereof accords with the conditions above, which will not be described in detail herein.

Specifically, the display method of the embodiment includes the following steps.

S101. An original image composed of a matrix of virtual pixels 2 is generated according to image information.

That is, the image information (i.e. content of image to be displayed) from a graphics card and the like is processed to generate an original image composed of a matrix of a plurality of 'points (i.e. virtual pixels 2)'; each virtual pixel 2 includes original components of red, green and blue colors, in order to represent the respective 'densities' of red, green and blue colors on the 'point'.

In this case, the term "component" in the above 'original component', subsequent 'display component' or the like refers to 'density' of the color which should be displayed in the corresponding location and can be represented by 'luminance', and the embodiment takes it as an example. Certainly, so long as each 'component' can represent the 'density' to be displayed, other metric parameters can also be adopted. For example, 'gray scale', 'saturation' or the like can be used as unit of the 'component'.

S102. Each virtual pixel 2 is arranged to correspond to a sampling location 8, a row of virtual pixels 2 correspond to a row of sampling locations 8. The virtual pixels 2 do not correspond to the sampling locations 8 one by one. Among the sampling locations 8 in each row, one sampling location 8 is further included between two sampling locations 8 corresponding to any two adjacent virtual pixels 2; in two adjacent rows of sampling locations 8, the sampling locations 8 corresponding to the virtual pixels 2 are not in the same columns, wherein each sampling location 8 is located between every two adjacent rows of sub-pixels 9, and corresponds to a location between two sub-pixels 9 in one row and a middle location of a sub-pixel 9 in the other row.

That is, as illustrated in FIG. 2, a plurality of 'sampling locations 8' will be formed on the display panel in accordance with the above arrangement mode. Specifically, each sampling location 8 is located between the two adjacent rows of the sub-pixels 9, and any sampling location 8 is located between two adjacent sub-pixels 9 in one adjacent row and also located in the middle of a sub-pixel 9 in the other adjacent row. Or rather, a central location of every three sub-pixels 9 which constitute a '品' arrangement is a sampling location 8. It can be seen that, the sampling locations 8 also constitute a 'matrix' of which row number is 1 less than that of the sub-pixels 9 and column number is 2 less than twice of the number (because the sub-pixels 9 in different rows are not aligned to each other in the column direction, it does not have column number) of the sub-pixels 9 in one row. Certainly, it should be understood that each sampling location 8 is not an entity which really exists but is only used for representing a corresponding location, and all the sampling locations 8 constitute a matrix for locating the locations of the virtual pixels.

The step is as illustrated in FIG. 3, each virtual pixel 2 in the virtual image is caused to correspond to each sampling location 8 mentioned above, in order to determine display components of the sub-pixels 9 in the subsequent process.

For clarity, in FIG. 3, no sampling location 8 is marked anymore but only virtual pixels 2 are marked, in which each virtual pixel 2 is represented by a triangle, and the number mn in the triangle represents the virtual pixel 2 in the $m^{th}$ row and the $n^{th}$ column. Therefore, the sampling locations 8 with the triangles represent the presence of the corresponding virtual pixels 2, and the rest sampling locations 8 without the triangle represent the absence of the virtual pixel 2. Specifically, the corresponding relationship between the virtual pixels 2 and the sampling locations 8 is as follows.

As shown in FIG. 3, each row of virtual pixels 2 correspond to a row of sampling locations 8 with "one interval", i.e. the sampling locations 8 corresponding to the virtual pixels 2 and that not corresponding to the virtual pixels 2 in a row of sampling locations 8 are arranged alternately; meanwhile, in the column direction, the sampling locations 8 corresponding to the virtual pixels 2 are not in the same columns, that is, in two adjacent rows of sampling locations 8, the sampling locations 8 corresponding to the virtual pixels are arranged to be "staggered", for example in one row of sampling locations 8, the odd numbered sampling locations correspond to the virtual pixels 2, while in the adjacent row of sampling locations 8, the even numbered sampling locations correspond to the virtual pixels 2.

It can be seen that, as for the virtual image with resolution of 1920 columns×1080 rows, about (3840 columns×1080 rows) sampling locations 8 are required. Accordingly, 1081 rows of real sub-pixels 9 each having 1921 sub-pixels 9 are required (1921×2−2=3840). As for the virtual image with resolution of 1920 columns×1080 rows, in the existing display method, (3×1920×1080) sub-pixels 9 are required to perform the display; while according to the display method of the embodiment, the amount of the required sub-pixels 9 is 1921×1081, which is approximately ⅓ of the amount of the sub-pixels 9 required in the existing display panel. Therefore, the display method of the embodiment can increase the display resolution by about 2 time while maintaining the physical resolution.

It can be seen that, after each virtual pixel 2 corresponds to the sampling location 8 in accordance with the above corresponding relationship, each virtual pixel 2 necessarily corresponds to three sub-pixels 9 (i.e. the sub-pixels 9 to which three vertexes of the triangle for representing the virtual pixel 2 in FIG. 3 point) around the corresponding sampling location 8. Correspondingly, each sub-pixel 9 necessarily corresponds to one or more virtual pixels 2 (i.e. the vertexes of one or more triangles for representing the virtual pixels 2 point to the sub-pixel 9).

Optionally, in the first row and last row of sub-pixels 9 of the display panel, in one row, except two sub-pixels 9 at the ends of the row, each sub-pixel 9 corresponds to two virtual pixels 2, the dimension of a sub-pixel 9 in this row in the column direction is ⅔ of that of a standard sub-pixel 9 in the column direction; in the other row, except two sub-pixels 9 at the ends of the row, each sub-pixel 9 corresponds to one virtual pixel 2, the dimension of a sub-pixel 9 in this row in the column direction is ⅓ of that of a standard sub-pixel 9 in the column direction. The standard sub-pixel refers to a sub-pixel which is not located at the edge of the display panel; in other words, said standard sub-pixel refers to a sub-pixel which is not located in the first row, last row and two ends of each row of the display panel.

According to the present embodiment, in the first row and last row of sub-pixels 9 of the display panel, each of the sub-pixels 9 (except the sub-pixels 9 at two ends) in one row (e.g. the first row in the present embodiment) correspond to one virtual pixel 2, and each of the sub-pixels 9 (except the sub-pixels 9 at two ends) in the other row (e.g. the last row in the present embodiment) correspond to two virtual pixels 2. Since most of the sub-pixels 9 on the display panel correspond to 3 virtual pixels 2, the amount of virtual pixels 2 corresponding to the sub-pixels 9 in the first row and last row is fewer, therefore the area of the sub-pixels 9 in the first row and last row should be decreased to avoid distortion of display image. Specifically, the heights of the sub-pixels 9 in those two rows (i.e. the dimension in the column direction) may be ⅓ or ⅔ of other sub-pixels 9 respectively.

Optionally, in each row of sub-pixels 9, one of the two sub-pixels 9 at the ends of the row corresponds to two virtual pixels 2, the dimension of this sub-pixel 9 in the row direction is ⅔ of that of a standard sub-pixel 9 in the row direction; the other sub-pixel 9 corresponds one virtual pixel 2, the dimension of this sub-pixel 9 in the row direction is ⅓ of that of a standard sub-pixel 9 in the row direction.

As can be seen from the figures, in most rows of sub-pixels (the rows including the standard sub-pixels 9), one of the sub-pixels 9 at the ends of the row corresponds to two virtual pixels 2, and the other sub-pixel 9 corresponds to one virtual pixel 2, and in any two adjacent rows, the positions of the sub-pixels 9 corresponding to one (or two) virtual pixel(s) 2 are reversed. Therefore, to avoid distortion of display image, the area of the sub-pixels 9 at the ends of each row should be decreased, for example by setting their "width (the dimension in the row direction)" as ⅓ or ⅔ of the width of a standard sub-pixel 9.

S103. The display component of each sub-pixel 9 is calculated in accordance with the original components of the corresponding colors of the virtual pixels 2 corresponding to the sub-pixel 9.

As previously mentioned, each sub-pixel 9 necessarily corresponds to one or more virtual pixels 2, whereby the content (display component) which should be displayed by each sub-pixel 9 can also be obtained by calculating the original components of the corresponding colors of the virtual pixels 2 corresponding to the sub-pixel, and the specific calculation method may be as follows.

The display component of one sub-pixel 9 is obtained by multiplying the original components of the corresponding colors of the virtual pixels 2 corresponding to the sub-pixels 9 by respective proportional coefficients and then summarizing the respective products.

That is, the display component of any one of the sub-pixels 9 is determined by the original components of the corresponding colors of the virtual pixels 2 corresponding to the sub-pixel in accordance with respective proportions.

In this case, the 'proportional coefficient' is preset, which is normally a nonnegative number, preferably a number between 0 and 1. Each virtual pixel 2 corresponding to each sub-pixel 9 has a proportional coefficient (which of course is a proportional coefficient for the corresponding color component thereof), and these proportional coefficients can be the same or different. The proportional coefficients for the virtual pixels corresponding to the different sub-pixels 9 also can be the same or different. One virtual pixel 2 corresponds to three sub-pixels 9 of different colors, so the proportional coefficients (or rather the proportional coefficients for the original components of different colors) corresponding to the three sub-pixels 9 also can be the same or different.

Optionally, the sum of the proportional coefficients for the original components of the corresponding colors of the virtual pixels 2 corresponding to one sub-pixel 9 is 1.

It can be seen that, the total luminance of the display panel is relevant to the proportional coefficients mentioned above, because each sub-pixel 9 is required to represent the contents of a plurality of the virtual pixels 2 at this time. Moreover, if the sum of the proportional coefficients for the original components of the corresponding colors of the virtual pixels 2 corresponding to one sub-pixel 9 is 1, the constant overall luminance of the display panel and the reality of the display effect can be guaranteed.

Optionally, for a virtual pixel 2 corresponding to the middle of any one of above standard sub-pixel 9, the proportional coefficient for the original component of the corresponding color of the virtual pixel 2 ranges from 0.5 to 0.9. Further optionally, the proportional coefficients for the original component of the corresponding color of the other two virtual pixels 2 are equal.

Except the few sub-pixels 9 at the edge, the respective standard sub-pixels 9 on the display panel correspond to 3 virtual pixels 2, and one out of the 3 virtual pixels 2 corresponds to the lower middle part of the standard sub-pixel 9, the other two virtual pixels 2 correspond to the up-left and up-right positions; the sum of the proportional coefficients for the 3 virtual pixels 2 is preferably 1. Optionally, the corresponding proportional coefficient for the virtual pixel 2 corresponding to the middle of the standard sub-pixel 9 ranges from 0.5 to 0.9, this proportional coefficient is large because the distance from the sampling location 8 corresponding to the virtual pixel 2 to the sub-pixel 9 is different from the distance from the sampling locations 8 corresponding to the other two virtual pixels 2 to the sub-pixel 9; meanwhile, the corresponding proportional coefficients for the other two virtual pixels 2 are preferably equal, because the distances from the sampling locations 8 corresponding to the two virtual pixels 2 to the sub-pixel 9 are the same.

For example, specifically, a display component $B_{S2G2}$ of a blue sub-pixel 9 with a coordinate of S2G2 may be equal to:

$$B_{S2G2}=X\times B_{21}+Y\times B_{11}+Z\times B_{12};$$

wherein $B_{21}$, $B_{11}$, $B_{12}$ are blue original components of the virtual pixels 2 with coordinates of (2,1), (1,1) and (1,2) respectively, and X, Y and Z are corresponding proportional coefficients. At this time, the sum of X, Y and Z is preferably 1, X preferably range from 0.5 to 0.9, Y and Z are preferably equal. The coordinate of the virtual pixel in the embodiment is represented in a Row-Column mode. For example, a coordinate of (2, 1) represents the second virtual pixel 2 in the second row, i.e. the virtual pixel 2 marked by 21.

Of course, for the sub-pixels 9 in the edge region except the standard sub-pixels 9, i.e. the sub-pixels 9 in the first row, the last row and two ends of each row, which correspond to different number of virtual pixels 2, the proportional coefficient for those sub-pixels 9 may be different.

It can be seen that, the calculations mentioned above only require multiplication and addition operations by using the proportional coefficients and the original components, so the process is simple and the required calculating amount is small.

It should be understood that it is also feasible to calculate the display components of the sub-pixels 9 by using other algorithms in accordance with the original components of the corresponding colors of the corresponding virtual pixels 2.

S104. Optionally, when the original components, the display components and the like mentioned above are luminance, the gray scale of each sub-pixel 9 may be calculated in accordance with the display component of the sub-pixel 9.

Specifically, for the display panel of 256 gray scales, the gray scale can be calculated by luminance through the following formula:

$$A=(G/255)^{\gamma}\times A_{255}$$

wherein A is luminance (i.e. display component) of a certain sub-pixel 9 obtained by calculation; $A_{255}$ is luminance of the sub-pixel having a gray scale value of 255; G is a gray scale value corresponding to the luminance A, which takes an integer between 0 and 255; and γ is a set gamma value.

At this time, all of A, $A_{255}$ and γ are known, so the gray scale G can be correspondingly calculated for subsequent steps.

It should be understood that the formula is also changed accordingly, if other modes such as 64 gray scales are adopted at this time. Or rather, the calculation method herein is different, if the original component and the display component adopt other units of measurement.

S105. The sub-pixels 9 are driven by the calculated gray scale values to display.

That is, each sub-pixel 9 displays the corresponding gray scale, thus obtaining a corresponding picture. FIG. 4 illustrates contrast of resultant images displayed by the existing method and the display method of the embodiment respectively for the same original image. It can be seen that, the image displayed by the display method of the embodiment has higher resolution, more exquisite structure, smoother color transition and better display effect.

In the display method of the present invention, the content displayed by each sub-pixel (i.e. standard sub-pixel) is substantially determined by three virtual pixels adjacent to this sub-pixel. That is, each sub-pixel is 'shared' by three virtual pixels. Or rather, each sub-pixel is used for representing the contents of the three virtual pixels at the same time, thereby enabling the visual resolution to be twice of the actual resolution in combination with a specific display panel, and a better display effect can be obtained. At the same time, the content displayed by each sub-pixel is directly obtained by calculation according to a plurality of specific virtual pixels without complex calculations such as 'partitioning, layering and area ratio'. Therefore, the display method is simple in process and small in calculating amount.

Embodiment 2

The present embodiment provides a display device comprising the display panel of Embodiment 1. The display panel may be a liquid crystal display panel or an organic light-emitting diode display panel. The display panel comprises a plurality of rows of sub-pixels, in which the sub-pixels in each row are formed by cyclically arranging sub-pixels of three colors, and the cyclical orders of the sub-pixels in the respective rows are the same, the adjacent sub-pixels in the column direction have different colors and are staggered from each other by ½ of the sub-pixel in the row direction.

Optionally, in the first row and last row of sub-pixels of the display panel, in one row, except two sub-pixels at the ends of the row, each sub-pixel corresponds to two virtual pixels, the dimension of a sub-pixel in this row in the column direction is ⅔ of that of a standard sub-pixel in the column direction; in the other row, except two sub-pixels at the ends of the row, each sub-pixel corresponds to one virtual pixel, the dimension of a sub-pixel in this row in the column direction is ⅓ of that of a standard sub-pixel in the column direction.

Optionally, in a row including the standard sub-pixels, one of the two sub-pixels at the ends of the row corresponds to two virtual pixels, the dimension of this sub-pixel in the row direction is ⅔ of that of a standard sub-pixel in the row direction; the other sub-pixel corresponds one virtual pixel, the dimension of this sub-pixel in the row direction is ⅓ of that of a standard sub-pixel in the row direction.

Optionally, the sub-pixels of three colors are a red sub-pixel, a blue sub-pixel and a green sub-pixel.

The display panel of the display device has the same structure and display method as that of Embodiment 1, the details thereof are omitted here.

It may be understood that, the foregoing embodiments are merely exemplary embodiments employed for illustration of the principle of the present invention, and the present invention is not limited thereto. For a person of ordinary skill in the art, various variations and improvements may be made without departing from the spirit and essence of the present invention, and those variations and improvements shall be regarded as falling into the protection scope of the present invention.

The invention claimed is:

1. A display method applied to a display panel, wherein the display panel comprises a plurality of rows of sub-pixels, the sub-pixels in each row are arranged in cyclical orders of sub-pixels of three colors, and the cyclical orders of the sub-pixels in the respective rows being the same; adjacent sub-pixels in a column direction having different colors and being staggered from each other by ½ of the sub-pixels in a row direction, wherein the display method comprises the following steps:

generating an original image composed of a matrix of virtual pixels;

enabling the matrix of virtual pixels to correspond to sampling locations, wherein among the sampling locations in each row, one sampling location is further included between two sampling locations corresponding to any two adjacent virtual pixels; in two adjacent rows of sampling locations, the sampling locations corresponding to the virtual pixels are not in same columns, wherein each sampling location is located between every two adjacent rows of sub-pixels, and corresponds to a location between two sub-pixels in one row and a middle location of a sub-pixel in another row; and calculating a display component of each sub-pixel in accordance with original components of corresponding colors of the virtual pixels corresponding to the sub-pixel;

wherein in a first row and a last row of sub-pixels of the display panel, in one row, except leftmost and rightmost sub-pixels of the row, each sub-pixel corresponds to two virtual pixels, a dimension of a sub-pixel in this row in the column direction is ⅔ of that of standard sized sub-pixels in the column direction; in the other of the first row and last row, except leftmost and rightmost sub-pixels of the row, each sub-pixel corresponds to one virtual pixel, a dimension of a sub-pixel in this row in the column direction is ⅓ of that of the standard sized sub-pixels in the column direction, and/or in each row including the standard sized sub-pixels, one of the leftmost and rightmost sub-pixels of the row corresponds to two virtual pixels, a dimension of this sub-pixel in the row direction is ⅔ of that of the standard sized sub-pixels in the row direction; the other of the leftmost and right most sub-pixels corresponds to one virtual pixel, a dimension of this sub-pixel in the row direction is ⅓ of that of the standard sized sub-pixels in the row direction.

2. The display method according to claim 1, wherein the display panel is a liquid crystal display panel or an organic light-emitting diode display panel.

3. The display method according to claim 1, wherein the sub-pixels of three colors are a red sub-pixel, a blue sub-pixel and a green sub-pixel.

4. The display method according to claim 1, wherein calculating the display component of each sub-pixel comprises:

obtaining the display component of each sub-pixel by multiplying the original components of the corresponding colors of the virtual pixels corresponding to the sub-pixel by respective proportional coefficients and then summarizing the respective products.

5. The display method according to claim 4, wherein a sum of the proportional coefficients for the original components of the corresponding colors of the respective virtual pixels corresponding to each sub-pixel is 1.

6. The display method according to claim 4, wherein the proportional coefficient for the original component of corresponding color of the virtual pixel corresponding to a middle of a standard sized sub-pixel ranges from 0.5 to 0.9.

7. The display method according to claim 6, wherein except the virtual pixel corresponding to the middle of the standard sized sub-pixel, the proportional coefficients for the original component of corresponding color of two other virtual pixels corresponding to the standard sized sub-pixel are equivalent to each other.

8. The display method according to claim 1, wherein both the original component and the display component are luminance and the method further comprises:

calculating a gray scale of each sub-pixel in accordance with the display component of the sub-pixel.

9. A display panel, comprising a plurality of rows of sub-pixels, sub-pixels in each row are arranged in cyclical orders of sub-pixels of three colors, and the cyclical orders of the sub-pixels in the respective rows being the same, adjacent sub-pixels in a column direction having different colors and being staggered from each other by ½ of sub-pixels in a row direction;

wherein in a first row and a last row of sub-pixels of the display panel, in one row, except two sub-pixels at ends of the row, each sub-pixel corresponds to two virtual pixels, a dimension of a sub-pixel in this row in the column direction is ⅔ of that of standard sized sub-pixels in the column direction; in the other of the first and last row, except two sub-pixels at ends of the row, each sub-pixel corresponds to one virtual pixel, a dimension of a sub-pixel in this row in the column direction is ⅓ of that of the standard sized sub-pixels in the column direction, and/or in each row including standard sized sub-pixels, one of two sub-pixels at ends of a row corresponds to two virtual pixels, a dimension of this sub-pixel in the row direction is ⅔ of that of the standard sized sub-pixels in the row direction; the other of the two sub-pixels at the ends of the row corresponds to one virtual pixel, a dimension of this sub-pixel in the row direction is ⅓ of that of the standard sized sub-pixels in the row direction.

10. The display panel according to claim 9, wherein the sub-pixels of three colors are a red sub-pixel, a blue sub-pixel and a green sub-pixel.

11. The display panel according to claim 9, wherein the display panel is a liquid crystal display panel or an organic light-emitting diode display panel.

12. A display device comprising a display panel, wherein the display panel comprises a plurality of rows of sub-pixels, sub-pixels in each row are arranged in cyclical orders of sub-pixels of three colors, and the cyclical orders of the sub-pixels in the respective rows are the same, adjacent sub-pixels in a column direction have different colors and are staggered from each other by ½ of the sub-pixels in a row direction;

wherein in a first row and a last row of sub-pixels of the display panel, in one row, except two sub-pixels at ends of the row, each sub-pixel corresponds to two virtual pixels, a dimension of a sub-pixel in this row in the column direction is ⅔ of that of standard sized sub-pixels in the column direction; in the other of the first row and last row, except two sub-pixels at the ends of the row, each sub-pixel corresponds to one virtual pixel, a dimension of a sub-pixel in this row in the column direction is ⅓ of that of the standard sized sub-pixels in the column direction, and/or in each row including standard sized sub-pixels, one of two sub-pixels at ends of the row corresponds to two virtual pixels, a dimension of this sub-pixel in the row direction is ⅔ of that of the standard sized sub-pixels in the row direction; the other of two sub-pixels at ends of the row corresponds to one virtual pixel, a dimension of this sub-pixel in the row direction is ⅓ of that of the standard sized sub-pixels in the row direction.

13. The display device according to claim 12, wherein the sub-pixels of three colors are a red sub-pixel, a blue sub-pixel and a green sub-pixel.

14. The display device according to claim 12, wherein the display panel is a liquid crystal display panel or an organic light-emitting diode display panel.

* * * * *